United States Patent [19]

Reed, Jr. et al.

[11] 4,239,073

[45] Dec. 16, 1980

[54] PROPELLANTS IN CASELESS AMMUNITION

[75] Inventors: Russell Reed, Jr., Ridgecrest, Calif.; William O. Munson; John A. Peterson, both of Brigham City, Utah

[73] Assignee: Thiokol Corporation, Newtown, Pa.

[21] Appl. No.: 329,257

[22] Filed: Jan. 17, 1973

[51] Int. Cl.[3] ..... C06B 45/10

[52] U.S. Cl. ..... 149/19.91; 149/60; 149/92; 149/109.4; 149/111

[58] Field of Search ..... 149/19.4, 19.91, 92, 149/111, 47, 60, 109.4

[56] References Cited

U.S. PATENT DOCUMENTS

| | | | |
|---|---|---|---|
| 3,309,247 | 3/1967 | Bluhm | 149/19.4 |
| 3,322,583 | 5/1967 | Guthrie et al. | 149/19.91 |
| 3,386,868 | 6/1968 | Gimler et al. | 149/19.91 |
| 3,427,295 | 2/1969 | Reed | 149/19.91 X |
| 3,480,490 | 11/1969 | Finger et al. | 149/111 |
| 3,507,722 | 4/1970 | Hamrick | 149/19.4 |
| 3,520,742 | 7/1970 | Witz | 149/19.91 X |
| 3,529,042 | 9/1970 | Lippert | 149/19.4 |
| 3,646,174 | 2/1972 | Macri | 149/87 |
| 3,668,026 | 6/1972 | Flanagan | 149/19.4 |
| 3,723,202 | 3/1973 | Butler et al. | 149/19.91 |
| 3,725,154 | 4/1973 | McCulloch et al. | 149/92 |
| 3,756,874 | 9/1973 | Chang et al. | 149/92 |
| 3,770,524 | 11/1973 | Walker et al. | 149/19.91 X |

*Primary Examiner*—Edward A. Miller
*Attorney, Agent, or Firm*—Thomas W. Brennan

[57] ABSTRACT

The compositions use oxidizers of HMX, RDX, ammonium nitrate, ammonium picrate and ammonium bitetrazole, and binders of lauryl methacrylate, glycidyl methacrylate, hydroxyethyl methacrylate, vinylene carbonate, polyformaldehyde mixtures were vinylene carbonate, and urethanes of polyethylene glycol and polyphenyl methylene isocyanate.

3 Claims, No Drawings

PROPELLANTS IN CASELESS AMMUNITION

The invention herein described as made in the course of or under contract with the U.S. Army (DAAD05-71-C-0166).

DESCRIPTION OF THE PRIOR ART

1. Field of the Invention

Caseless ammunition propellant, and more particularly, compositions of HMX, RDX, ammonium bitetrazole, ammonium picrate, or ammonium nitrate with binders of methacrylate, and urethanes.

2. Description of the Prior Art

Ammunition made with conventional smokeless powders, such as nitroglycerine, are not suitable, particularly for caseless ammunition, because of their low ignition point and low thermal stability. This results in cook-off and ignition prior to firing from the gun chamber. Methods and compositions have been proposed to overcome these cook-off, low thermal stability and fabrication difficulties of nitroglycerine.

Flame suppressants, such as potassium sulfate and chrysolite, have been added to nitroglycerine compositions, as described in U.S. Pat. Nos. 2,995,430, 3,116,190, 3,625,782, and 3,026,672, to increase the thermal stability of the compositions. Erosion protectors such as feldspar, kaolinite, or plastic polymer fibers have been used, as taught in U.S. Pat. Nos. 3,392,669 and 3,209,689, to aid in protecting the gun barrel. Other methods are to control the porosity of the grains as described in U.S. Pat. Nos. 3,563,177 and 3,673,286.

Compositions are described in the prior art to remove the drawbacks of nitroglycerine propellants in rocket propulsion. However, rocket propulsion problems are not the same as gun propellant problems. In rockets, the gases, toxic and corrosive materials, are vented to the atmosphere during ignition and burning. Furthermore, the propellant ignites and burns at a constant rate. But in guns, particularly in a rapid firing gun, the propellant must ignite and burn very rapidly and have no corrosive features to achieve the ballistic requirements of the weapon. Some of the rocket propellant compositions use 1,3,5,7-tetranitrazacyclooctane (HMX), acrylate rubbers and desensitizing agents, others use nitroglycerine encased in an epoxy resin matrix, and others use propyl ether, peroxides, and methacrylate mixtures as described in U.S. Pat. Nos. 3,386,868, 3,676,233, and 3,666,578. In other compositions fluorocarbons and oxidizers, nitro acetals, ammonium nitrate and urea, castable nitrated polymers, polyurethane free from gas voids, and low temperature curing propellant binders are used to overcome casting and curing problems. These compositions are described in U.S. Pat. Nos. 3,629,020, 3,031,598, 3,000,718, 2,817,581, 3,068,129, 3,020,491, 3,532,567, and 3,532,566. None of these compositions have the requirements for a gun propellant. The compositions of this invention overcome the drawbacks and provide powder compositions with a low flame temperature and a high thermal stability, by synergistically combining oxidizers with binder compositions of curable polymers with large radicals on the carbon backbone of the polymer.

SUMMARY OF THE INVENTION

Propellants, suitable for caseless ammunition, comprise at least one oxidizer selected from the group consisting of HMX, RDX, ammonium nitrate, ammonium picrate and ammonium bitetrazole, and a binder which synergistically reacts with the oxidizer. The binder has at least one polymer that is chosen from lauryl methacrylate, glycidyl methacrylate, hydroxyethyl methacrylate, vinylene carbonate, polyformaldehyde mixtures with vinylene carbonate, polyethylene glycol (average molecular weight between 1,540 and 4,542) polymerized with polyphenyl methylene isocyanate, and tolylene diisocyanate polymerized with trimethylolpropane and polyethylene glycol (average molecular weight of 1,540). The oxidizer varies between 70 and 80 weight percent of the total composition weight, and has a particle size between 6 and 150 microns. The weight percent of the polyethylene glycol to binder weight is from 75 to 95 percent.

DESCRIPTION OF THE PREFERRED EMBODIMENTS

Propellant compositions suitable for caseless ammunition requires synergistic interaction of the ingredients. The oxidizers or deflagrating additives must be compatible with the binder components, that is chemical and physical bonds must be formed between the polymeric binders and the oxidizer. The deflagrating additive must be of a specific size to aid in controlling the burning rate, and the binder components must rapidly absorb energy by endothermic dissociation of the oxidizer to yield low molecular weight gases, an effect which results in a low flame temperature, and a high mass impetus.

The chemical theories involved in propellant compositions show that they must be individually synthesized and that there are no established rules by which a particular compositions can be established a priori. The proof lies in one fact: does the composition meet the firing requirements of the gun?

In this invention, the following compositions were found to compare well with the firing properties of nitroglycerine, and are more thermally stable so as not to ignite prematurely in a hot gun chamber, as does the nitroglycerine and other propellant compositions now available on the market.

The propellant compositions of this invention have oxidizing compositions which vary between 70 to 80 weight percent of the total propellant weight.

Suitable binders are lauryl methacrylate, glycidyl methacrylate, hydroxyethyl methacrylate, vinylene carbonate, polyformaldehyde and vinylene carbonate mixtures, polyethylene glycol with an average molecular weight between 1,540 and 4,542 polymerized with polyphenyl methylene isocyanate, and a polymer of trimethylolpropane polyethylene glycol and tolylene diisocyanate.

Suitable deflagrating additives or oxidizers which synergistically interact with the binders are: HMX, RDX, ammonium nitrate (AN), ammonium bitetrazole, and ammonium picrate. Examples of propellant compositions and the weight percent of their components are given in Table I. In Table I, TPE-4542 refers to polypropylene glycol with an average molecular weight of 4,542; PAPI refers to polyphenylmethylene isocyanate; and TDI refers to tolylene diisocyanate.

The compositions of this invention had autoignition times within the range of 9 to 23 seconds at 550° F. as compared to 1.9 and 4.5 seconds for the improved military rifle smokeless powder and the military ball powder. The autoignition tests were conducted as described in ASTM Method No. D-286.

TABLE I

| Formulation No. | 55-B | 55-C | 56-A | 54-B | 55-E | 55-D | 56-B | 56-C |
|---|---|---|---|---|---|---|---|---|
| Component, wt % | | | | | | | | |
| TPE-4542 | 18.4 | 23.0 | — | | 18.4 | 18.4 | | |
| PAPI | 1.6 | 2.0 | — | | 1.6 | 1.6 | | |
| Lauryl methacrylate | | | 20.0 | | | | 20.0 | 20.0 |
| Polyethylene glycol 1540 | | | | 15.6 | | | | |
| TDI | | | | 3.5 | | | | |
| Trimethylolpropane (TMP) | | | | 0.9 | | | | |
| RDX | | | | | 80.0 | | | 80.0 |
| AN | | | | | | 10.0 | 10.0 | |
| HMX - 150 microns | 42.0 | 37.0 | 42.0 | | | | | |
| 60 microns | 10.0 | 10.0 | 10.0 | | | | | |
| 6 microns | 16.0 | 16.0 | 16.0 | | | | | |
| 20 microns | 12.0 | 12.0 | 12.0 | | | | | |

The invention described is not to be limited only by the examples shown but by the scope of the claims. Equivalents can be substituted without departing from the scope of this invention.

We claim:

1. A gun propellant composition comprising a major amount of a finely divided deflagrating component selected from cyclotetramethylene tetranitramine, cyclotrimethylene trinitramine, ammonium nitrate, ammonium picrate, ammonium bitetrazole and mixtures thereof, and a minor amount of a binder which is poly(lauryl methacrylate).

2. A gun propellant according to claim 1 comprising 70% to 80% by weight of said deflagrating component and 20% to 30% by weight of said binder.

3. A gun propellant composition comprising a major amount of particulate cyclotetramethylene tetranitramine and a minor amount of a binder which is poly(lauryl methacrylate).

* * * * *